US008684040B2

(12) United States Patent
Bernitsas et al.

(10) Patent No.: US 8,684,040 B2
(45) **Date of Patent: *Apr. 1, 2014**

(54) REDUCTION OF VORTEX INDUCED FORCES AND MOTION THROUGH SURFACE ROUGHNESS CONTROL

(75) Inventors: Michael M. Bernitsas, Saline, MI (US); Kamaldev Raghavan, Houston, TX (US)

(73) Assignee: The Regents of The University of Michigan, Ann Arbor, MI (US)

( * ) Notice: Subject to any disclaimer, the term of this patent is extended or adjusted under 35 U.S.C. 154(b) by 1328 days.

This patent is subject to a terminal disclaimer.

(21) Appl. No.: 12/125,409

(22) Filed: May 22, 2008

(65) Prior Publication Data

US 2009/0114002 A1 May 7, 2009

Related U.S. Application Data

(60) Provisional application No. 60/931,942, filed on May 25, 2007.

(51) Int. Cl.
*F15C 1/16* (2006.01)

(52) U.S. Cl.
USPC ..... 137/808; 290/53; 405/211; 416/6

(58) Field of Classification Search
USPC ..... 137/803, 808, 810; 224/130, 134 E, 200, 224/204; 114/243, 253, 67 A, 67 R; 405/211, 216; 416/6, 9; 290/42, 53
See application file for complete search history.

(56) References Cited

U.S. PATENT DOCUMENTS 3,959,663 A 5/1976 Rusby
4,024,409 A 5/1977 Payne
4,059,129 A * 11/1977 Feis ..... 138/37
4,241,579 A 12/1980 Borgren
4,413,956 A 11/1983 Berg
5,426,332 A 6/1995 Ullman et al.
5,755,408 A * 5/1998 Schmidt et al. ..... 244/204
5,909,782 A * 6/1999 Pluff et al. ..... 180/309
6,153,944 A 11/2000 Clark (Continued)

OTHER PUBLICATIONS

Holzman, David C., "*Blue Power—Turning Tides Into Electricity*," Dec. 2007, Environment Health Perspectives (Environments/Innovations), vol. 115, No. 12, pp. A591-A593.

(Continued)

*Primary Examiner* — Craig Schneider
(74) *Attorney, Agent, or Firm* — Harness, Dickey & Pierce, P.L.C.

(57) ABSTRACT

Roughness is added to the surface of a bluff body in a relative motion with respect to a fluid. The amount, size, and distribution of roughness on the body surface is controlled passively or actively to modify the flow around the body and subsequently the Vortex Induced Forces and Motion (VIFM). The added roughness, when designed and implemented appropriately, affects in a predetermined way the boundary layer, the separation of the boundary layer, the level of turbulence, the wake, the drag and lift forces, and consequently the Vortex Induced Motion (VIM), and the fluid-structure interaction. The goal of surface roughness control is to decrease/suppress Vortex Induced Forces and Motion. Suppression is required when fluid-structure interaction becomes destructive as in VIM of flexible cylinders or rigid cylinders on elastic support, such as underwater pipelines, marine risers, tubes in heat exchangers, nuclear fuel rods, cooling towers, SPAR offshore platforms.

12 Claims, 5 Drawing Sheets

(56) References Cited

U.S. PATENT DOCUMENTS

| | | | | |
|---|---|---|---|---|
| 6,619,887 | B1 | 9/2003 | Szewczyk et al. | |
| 6,872,048 | B2 * | 3/2005 | Uselton et al. | 415/119 |
| 6,908,063 | B2 | 6/2005 | Bearman et al. | |
| 8,047,232 | B2 * | 11/2011 | Bernitsas et al. | 137/808 |
| 2006/0054073 | A1 * | 3/2006 | Muehlner | 114/243 |

OTHER PUBLICATIONS

Kumar, Raghavan A., Sohn, Chan-Hyun and Gowda, Bangalore H.L., "*Passive Control of Vortex-Induced Vibrations: An Overview*," Recent Patents on Mechanical Engineering, 2008, vol. 1, No. 1, pp. 1-11.

* cited by examiner

REDUCTION OF VORTEX INDUCED FORCES AND MOTION THROUGH SURFACE ROUGHNESS CONTROL

CROSS-REFERENCE TO RELATED APPLICATIONS

This application claims the benefit of U.S. Provisional Application No. 60/931,942 filed on May 25, 2007. The disclosure of the above application is incorporated herein by reference.

GOVERNMENT INTEREST

This invention was made with government support under N00014-03-1-0983 awarded by the Office of Naval Research and DE-FG36-05GO15162 awarded by the Department of Energy. The government has certain rights in the invention.

FIELD

The present disclosure relates to reduction of vortex induced forces and, more particularly, relates to reduction of vortex induced forces using surface roughness control.

BACKGROUND AND SUMMARY

The statements in this section merely provide background information related to the present disclosure and may not constitute prior art.

Roughness is added to the surface of a bluff body in a relative motion with respect to a fluid. The amount, size, and distribution of roughness on the body surface is controlled passively or actively to modify the flow around the body and subsequently the Vortex Induced Forces and Motion (VIFM). The added roughness, when designed and implemented appropriately, affects in a predetermined way the boundary layer, the separation of the boundary layer, the level of turbulence, the wake, the drag and lift forces, and consequently the Vortex Induced Motion (VIM), and the fluid-structure interaction. The goal of surface roughness control is to decrease/suppress Vortex Induced Forces and Motion. Suppression is required when fluid-structure interaction becomes destructive as in VIM of flexible cylinders or rigid cylinders on elastic support, such as underwater pipelines, marine risers, tubes in heat exchangers, nuclear fuel rods, cooling towers, SPAR offshore platforms. The name of this invention is VIM-Reduce and is based on Surface Roughness Control (SRC). It is hereafter referred to as VIM-Reduce+SRC.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

Figure 8:
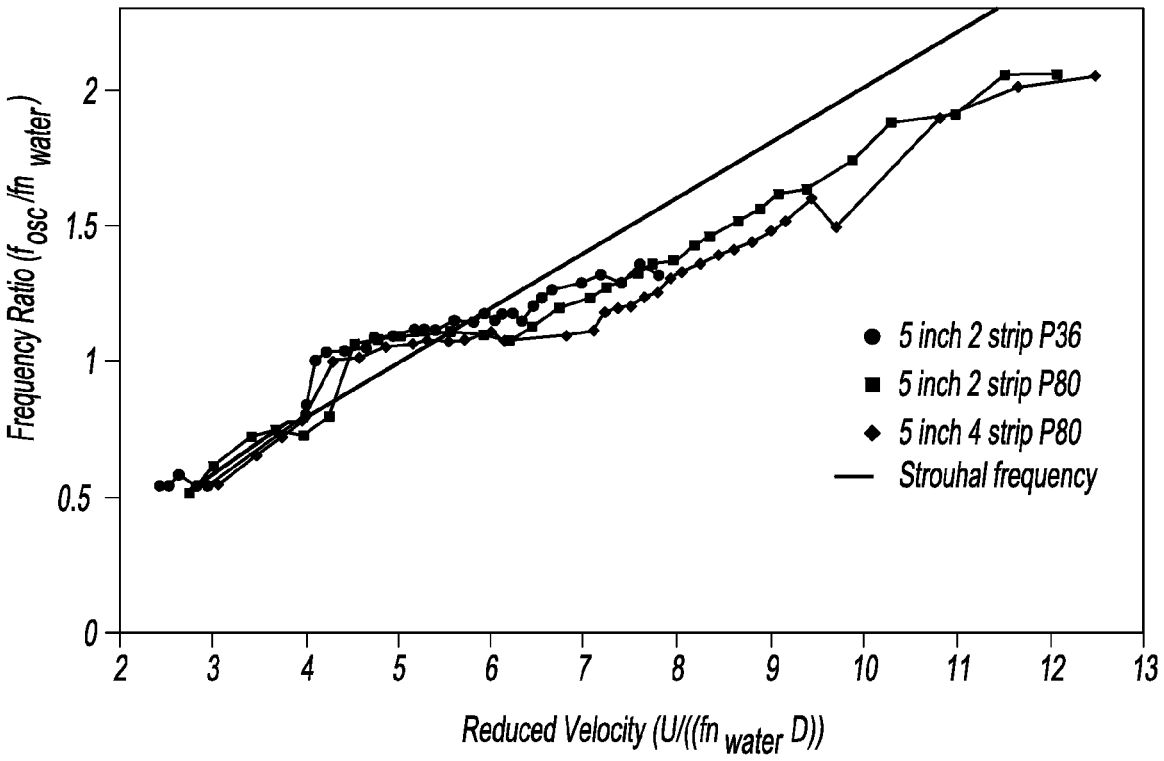
Figure 9:
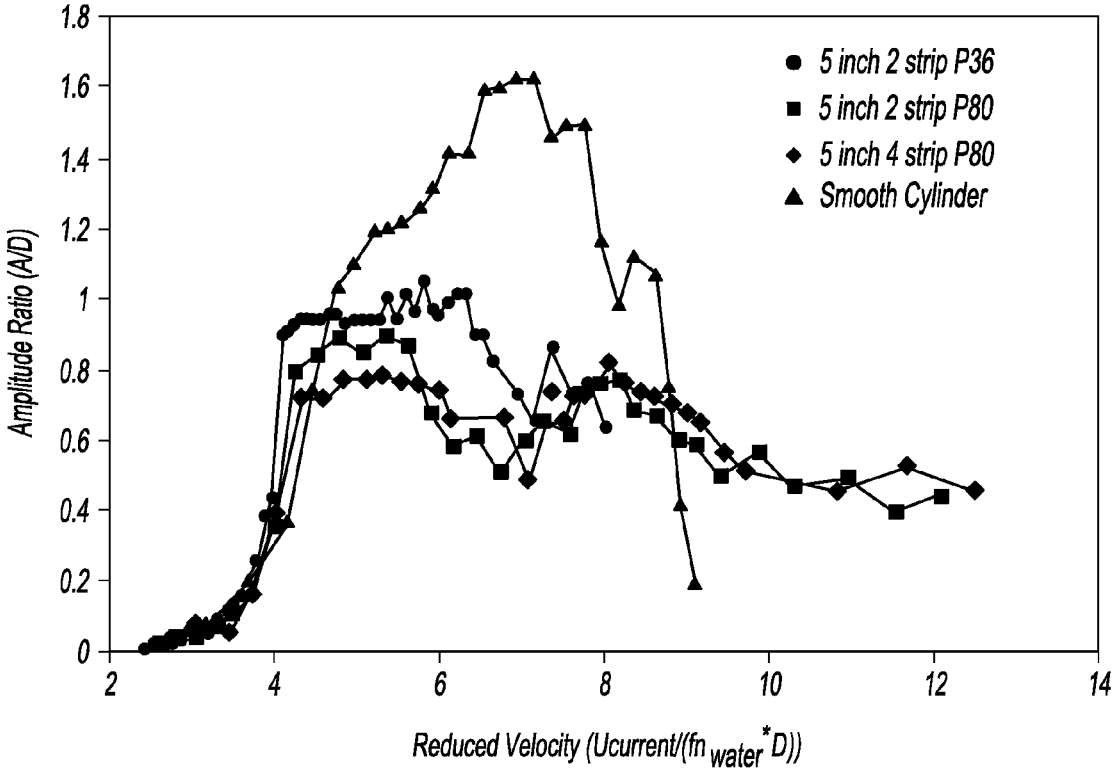

FIG. 8 is a graph illustrating the reduced velocity versus the frequency ratio for two-strip cases having P36 and P80 roughness strips placed at 80°-102.9° symmetrically and four-strip cases for 5" cylinder with two more strips placed symmetrically at 117°-140°; and FIG. 9 is a graph illustrating the reduced velocity versus the amplitude ratio for two-strip cases having P36 and P80 roughness strips placed at 80°-102.9° symmetrically and four-strip cases for 5" cylinder with two more strips placed symmetrically at 117°-140°.

DETAILED DESCRIPTION

The following description is merely exemplary in nature and is not intended to limit the present disclosure, application, or uses.

1.1 General Principles

There are three types of fluid induced loading on a structure which may result in structural vibration: (a) Extraneously Induced Excitation (EIE), (b) Instability-Induced Excitation (IIE), and (c) Movement Induced Excitation (MIE). In each cases, the fluid relative flow initiates excitation. For bluff bodies in relative flows, shedding of large vortices occur following flow separation at the end of the boundary layer and coalescence of vorticity generated at the boundary layer and along the shear layer into large vortices. The latter are called von Karman vortices and have a core diameter (dr) on the order of the bluff body linear dimension (D) transverse to the flow. Hereafter, vortex shedding refers to von Karman vortices.

Control of vortex shedding behind a bluff body and control of vortex induced motion of a bluff elastic body or bluff rigid body on elastic support have been topics of research and patenting for over a hundred years (Zdravkovich 1997). Applications appear in several engineering disciplines such as offshore engineering, aerospace, mechanical, civil, nuclear, and power transmission. In ocean engineering, suppression of vortex shedding is important because of the destructive effect of vortex induced vibration on marine risers, underwater pipelines, SPAR offshore platforms, etc. In other engineering disciplines, Vortex Induced Vibration (VIV) of cylindrical structures, such as tubes in heat exchangers, cooling towers, nuclear fuel rods, and smoke stacks can be destructive and must be suppressed. Control of vortex shedding for suppression of VIFM can be achieved by active control, passive control, or combination thereof.

Suppression of vortex shedding has previously been investigated and broadly classified into three categories:

Disturbing the spanwise correlation with devices such as helical strakes, wires, studs or spheres, and wavy body surfaces.

Affecting the shear layer emanating from both sides of a bluff body with devices such as shrouds.

Preventing the interaction of the entrainment layers with devices such as splitter plate and base-bleed.

Hereafter the present teachings are referred to as VIM-Reduce+SRC. In accordance with these teachings, VIM control by introducing Surface Roughness Control (SRC) on the structure can be achieved. The goal is to reduce/suppress VIFM using SRC. Historically, suppression of VIFM has been, and still is, extremely important when VIFM becomes destructive.

A plethora of methods and devices have been developed to suppress VIFM, however none of those uses surface roughness to suppress VIFM.

2.1. The Underlying Principles

The underlying principles for the present teachings (VIM-Reduce+SRC) are the following two:

Principle #1: Decreasing the Correlation Length Using Surface Roughness

Surface roughness of appropriate size and distribution can decrease the spanwise correlation of vortex shedding along a bluff body. Decreased correlation length results in decreased lift forces and subsequent decrease and possible suppression of VIFM.

Principle #2: Controlling the Boundary Layer Turbulence Using Surface Roughness

Surface roughness of appropriate size and distribution can increase or decrease turbulence at the boundary layer scale which feeds the shear layer along a bluff body and in turn affects the momentum of the separating shear layer. VIM-Reduce+SRC uses these two principles to decrease VIFM.

2.2. Terminology

Terms that are used in describing the present teaching of Surface Roughness Control (SRC), as well as the physics behind it, are defined below:

Structure refers to a body in a relative fluid flow. The body can be elastic, elastically mounted, rigid, or a combination of structural parts thereof. Vortex shedding behind the structure (typically a bluff body) is expected. Shed vortices may induce forcing and motion.

A bluff body has a non-streamlined shape that produces considerable resistance when immersed in a moving fluid. A region of separated flow occurs over a large portion of the surface of a bluff body, which results in a high pressure drag force and a large wake region. The flow often exhibits unsteadiness in the form of periodic vortex formation and shedding, which may result in periodic forces transverse (lift forces) to the fluid flow. Bluff bodies are widely encountered in many engineering applications and design problems, including bridges, stacks, towers, offshore pipelines, offshore structures, heat exchangers, mooring lines, flagpoles, car antennas, and any circular or cylindrical body having a size ranging from about 0.1 mm or larger.

In some embodiments, surface roughness can be defined as any two or three-dimensional excrescence whose dimension perpendicular to the body surface, k, is on the order of the boundary layer thickness. However, in some embodiments, surface roughness can be defined as any two or three-dimensional excrescence whose dimension perpendicular to the body surface, k, is no more than about 5% of the largest linear dimension, D, of the cross section of the bluff body in the plane of the flow. For example, a plane perpendicular to an axis of a cylindrical member (e.g. a circle) defines a plane of the fluid flow. Such elements can be closely or sparsely packed. Depending on the application, roughness may cover the entire structure or any part thereof. According to the present teachings, three-dimensional roughness elements are used. Roughness textures can contain irregular size and shape of excrescences—uniformly or non-uniformly distributed. Examples include: pyramidal, grooves, brickwall type, and wire gauze. Roughness can be hard or soft. It should also be appreciated that such surface roughness can be in the form of affix members, such as sandpaper or other friction member; can be machined or otherwise formed on the bluff body; can be an active configurable member(s); and the like.

Passive/active control refers to the way of applying surface roughness to control turbulence generated in the boundary layer. Passive control implies that the added roughness is fixed on the surface of the structure and is not adjustable to meet flow fluctuations. Active control implies that distribution and/or size of applied surface roughness are altered during operation depending on flow conditions.

Boundary layer is the layer of fluid in the immediate vicinity of the structure. A measure of its thickness is $\delta$, which is the distance perpendicular to the surface of the structure where the flow velocity has reached 99% of the outer flow velocity ($U_\infty$). The relative flow velocity on the surface of an impermeable/nonporous structure is zero.

Separation point is the point on the surface of the structure where the gradient of the relative velocity tangential to the surface of the structure with respect to the direction perpendicular to the surface of the body is zero.

Flow Turbulence refers to the three dimensional, unsteady motions of fluid particles in a practically chaotic manner.

Wake is the region of turbulence immediately to the rear of a solid body caused by the flow of fluid around the body.

Von Karman vortices are the vortices formed behind a bluff body, such as a cylinder. By coalescence of vorticity generated at the boundary layer and the shear layer on each side of the bluff body.

Drag is the force that resists the movement of a body through a fluid. Drag is the sum of frictional forces, which act tangentially to the body surface, and the component of the pressure forces parallel to the fluid flow. For a body, the drag is the sum of fluid dynamic forces in the direction parallel to the fluid flow.

Lift is the sum of all the fluid dynamic forces on a body in the direction perpendicular to the direction of the relative fluid flow.

Fluid-structure interaction is the phenomenon where the fluid forces exerted on the structure move or deform the structure whose motion in turn affects the fluid forces exerted on the structure. Thus, the dynamics of the structure and the fluid are interdependent.

Vortex Induced Motion (VIM) is a fluid-structure interaction phenomenon where the motion of a bluff structure is induced primarily by the vortices shed into the wake of the structure due to the relative flow between the fluid and the structure.

Figure 2:
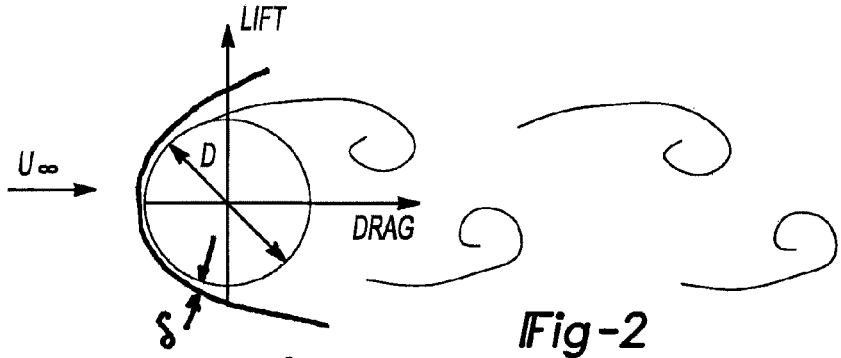
FIG. 2 is a schematic drawing illustrating vortex formation and wake.

Vortex Induced Vibration (VIV) is a special case of VIM where forcing is predominantly periodic. A well known VIV phenomenon may occur when a flexible circular cylinder or a rigid circular cylinder on elastic support is placed in a steady flow with its axis perpendicular to the direction to the flow. In VIV, synchronization of vortex shedding and cylinder oscillation occurs over a broad range of flow velocities. FIG. 2 shows a typical periodic vortex formation and wake for a circular cylinder in VIV.

Vortex Induced Forces and Motion (VIFM) refers to both the forces and motion induced by vortex shedding.

2.3. Method of Control of Vortex Induced Forces and Motion (VIFM)

The method implemented according to the present teachings, in order to control the VIFM of the structure, is based on Principles #1 and #2 above. Specifically, surface roughness is added, to modify passively or actively, the strength and three-dimensional distribution of turbulence which in turn affects vortex shedding, and subsequently vortex induced motion of the structure. The three elements of control of the method implemented according to the present teachings are surface roughness control, turbulence control, and control of vortex induced forces and motion, which are described next.

Surface Roughness Control:

An objective of surface roughness is to alter vortex shedding and its effects, including but not limited to vortex induced forces and vortex induced motion. To this end, part or all of the surface of the structure may be covered by roughness elements.

Figure 5:
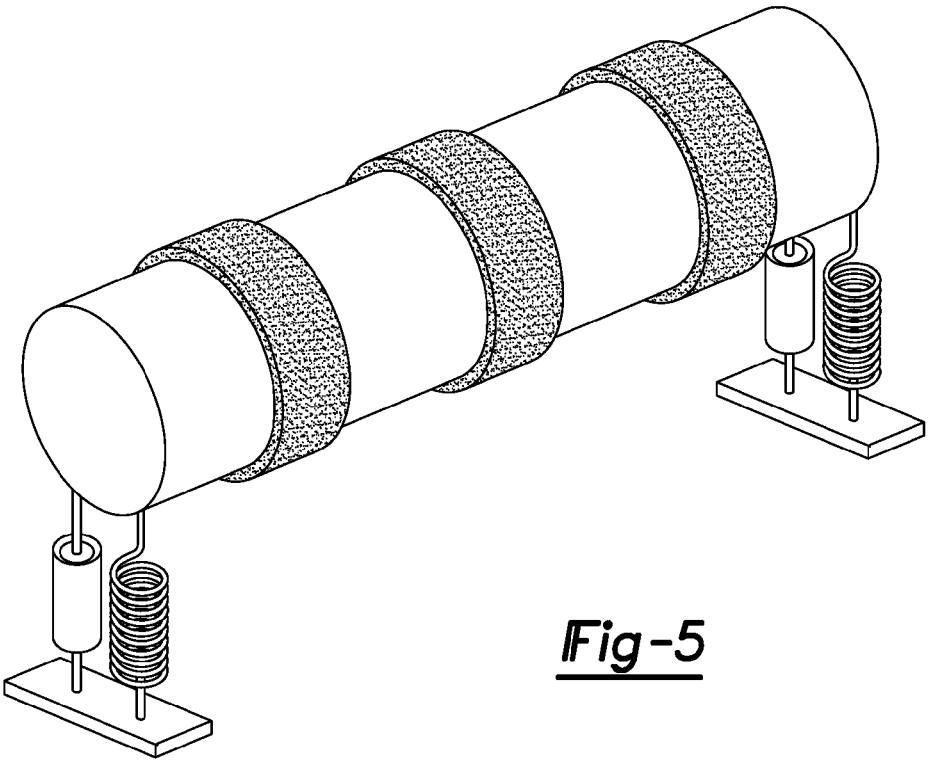
FIG. 5 is a perspective view illustrating reduction/suppression of VIFM using surface roughness control according to one embodiment of the present teachings.
Figure 6:
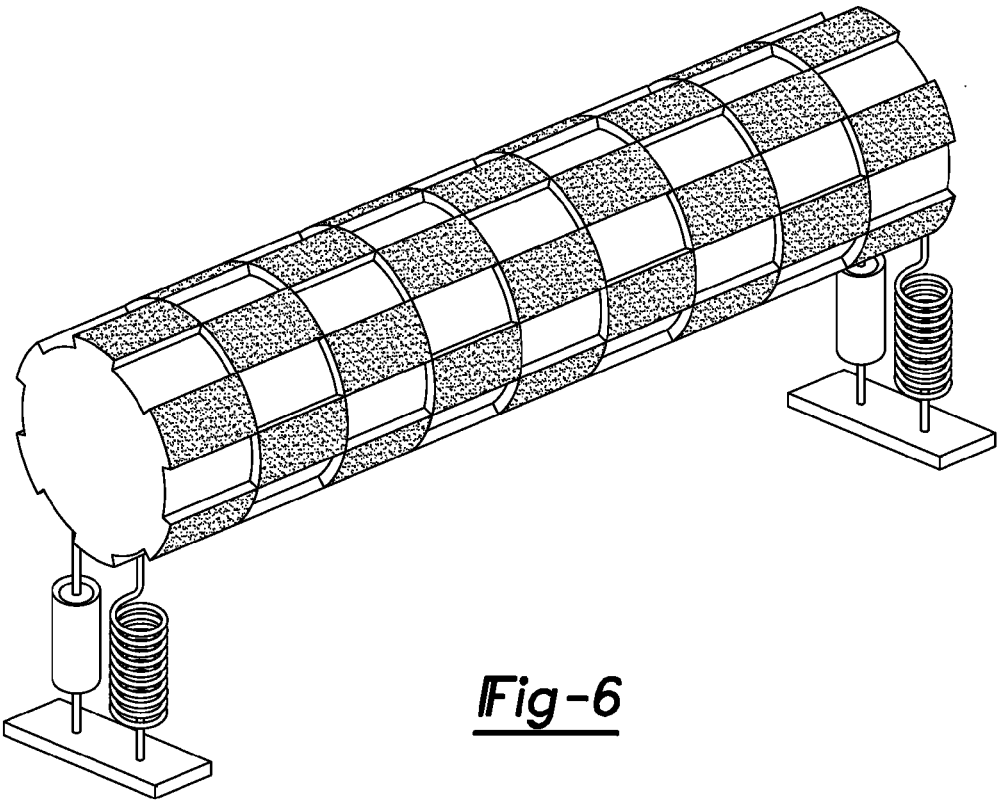
FIG. 6 is a perspective view illustrating reduction/suppression of VIFM using surface roughness control according to another embodiment of the present teachings.

Distribution of surface roughness depends on the objective of decreasing or increasing vortex induced forces and motion. FIG. 5 and FIG. 6 depict two methods of distributing roughness to reduce and possibly suppress vortex induced forces and motion.

Passive roughness control consists of distributing roughness elements on the surface of the structure permanently without the possibility of adjusting their configuration during the flow.

Active roughness control consists of altering size and distribution of the roughness on the surface of the structure based on relative flow characteristics such as direction and magnitude of velocity, which affect, properties of the boundary layer such as thickness, and separation.

Turbulence Control:

The present teachings, VIM-Reduce+SRC, control the amount and distribution of turbulence in a flow past a structure, by distributing roughness on the surface of the body as described herein. Some specific ways in which surface roughness affects turbulence and consequently the flow past the structure are described herein Control of Flow Correlation Using Roughness:

Spanwise vortex shedding correlation behind a bluff body is typically limited. For example, for a stationary cylinder in a steady flow perpendicular to its axis, the correlation length $l_c$ is 2-3 cylinder diameters unless the cylinder is in VIV. Theoretically, VIV induces infinite correlation length resulting in increased VIFM. In practice, the correlation length in VIV is large but finite. A way of controlling VIFM is by controlling the correlation length. Decrease in the correlation length results in decreased Vortex Induced Forces and Motion.

Figure 4:
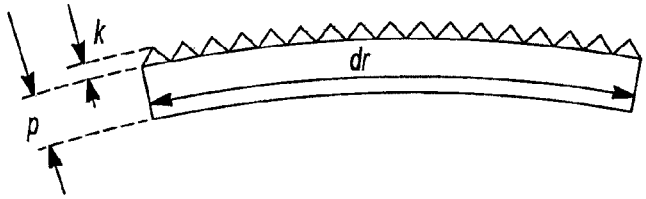
FIG. 4 is an enlarged schematic drawing illustrating the surface roughness member of FIG. 3.

FIG. 5 and FIG. 6 shows use of roughness strip for VIFM reduction. This strip is more effective than a trip-wire because of the inherent oscillatory nature of the separation point. The roughness strips accommodate the oscillatory nature of the separation points because of their depth $d_r$ as shown in FIG. 4.

The roughness strip is broken down into short, discontinuous, and staggered strips of variable roughness as shown in FIG. 5. This application of the VIM-Reduce+SRC invention exploits the phenomenon that reducing the spanwise correlation along the separation lines or shear layers, weakens correlated vortex shedding and the induced alternating forces. This reduction in correlation results in reduction/suppression of VIFM. To accommodate variation in direction of the relative fluid flow, the roughness strips would be distributed around the body. Another variation of distribution of roughness that can reduce/suppress VIM is shown in FIG. 6.

Control of Flow Separation Using Roughness:

A flow past a structure typically separates at two separation points, one on each side of any cross section of the structure. Using the roughness strips before the regular separation point determines the nature of the flow downstream. The flow can be laminar, or in transition between laminar and turbulent, or turbulent. In each case, control of separation using roughness may have different effect on the flow and consequently VIFM.

The most profound effect of separation point control appears in the critical flow regime. Transition from laminar to turbulent flow can be controlled using roughness strip/s. This exploits the concept of tripping the boundary layer and energizing the boundary layer with eddies that are shed from the roughness elements in the roughness strip/s. Depending on the size, width, height of the strips and the location of the roughness strip/s, the flow can be controlled to reattach in a laminar or turbulent manner forming a separation bubble. The size of the separation bubble can be controlled changing the roughness configuration. The size of the separation bubble is linked to the pressure loss; the larger the bubble, the larger the loss of pressure, and the larger the loss in lift.

Control of Vortex Induced Forces and Motion:

In some embodiments, the goal of the present teachings, VIM-Reduce+SRC, is to decrease Vortex Induced Forces and Motion. This is achieved by controlling turbulence as described herein, such as through roughness control. Suppression is required when fluid-structure interaction becomes destructive as in VIV of flexible cylinders or rigid cylinders on elastic support, such as underwater pipelines, marine risers, tubes in heat exchangers, nuclear fuel control rods, cooling towers, SPAR offshore platforms.

2.4. New Elements of the Present Teachings

Figure 7:
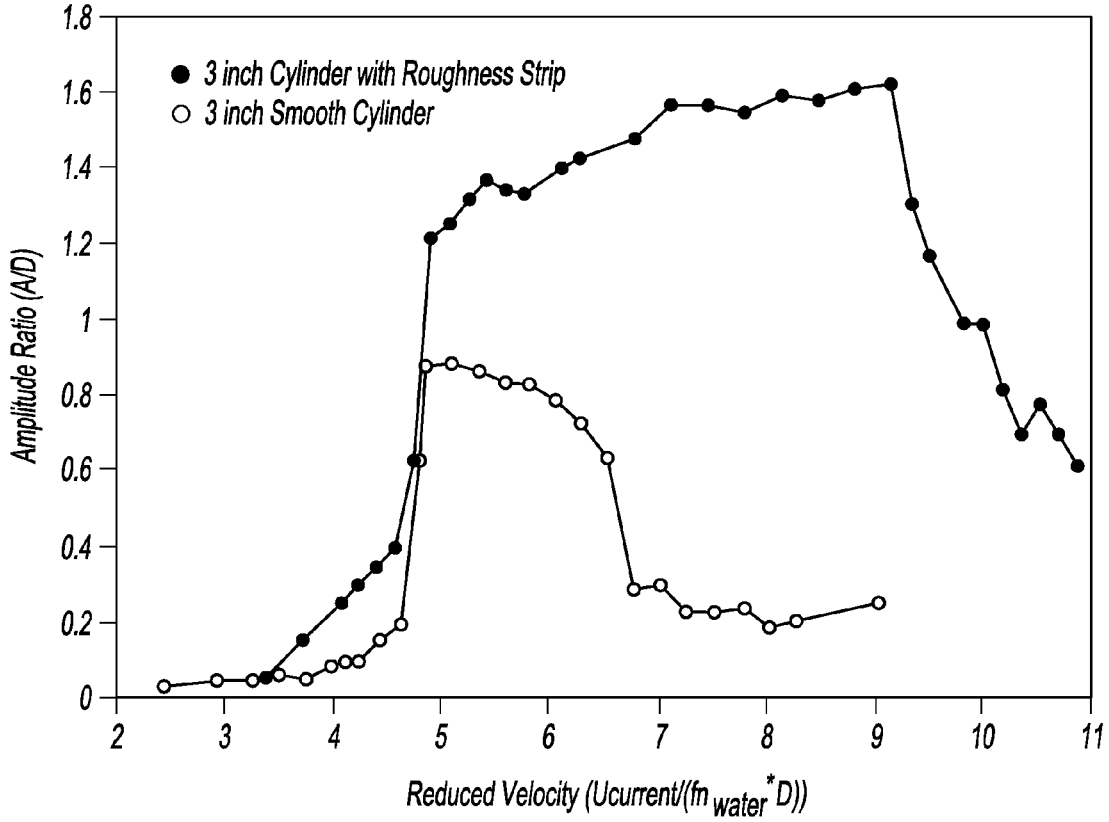
FIG. 7 is a graph illustrating the reduced velocity versus the amplitude ratio (A/D) of a 3.0" cylinder with and without roughness (Case 1)

The present teachings, specifically VIM-Reduce+SRC, are composed of simple and readily available components, which are described below, but define an innovative design based on many of the newly applied principles. Specifically, the present teachings may provide at least some of the following advantages:

It reduces/suppresses Vortex Induced Forces and Motion of the structure in a relative flow as shown in FIG. 7. As an example, this is needed to prevent damage of structures such as marine risers, pipelines, smoke stacks, cooling towers, nuclear fuel rods, power transmission lines, and bridges.

It reduces the spanwise flow correlation length to a low value by appropriate design of size and distribution of roughness on the surface of the body as shown in the examples in FIG. 5 and FIG. 6.

It decreases the range of synchronization of VIFM of the structure in a relative flow as shown in the lab measurements in FIG. 7.

It affects the point of separation by appropriate design of size and distribution of roughness on the surface of the body.

It affects the turbulence shed into the wake by appropriate design of size and distribution of roughness on the surface of the body.

2.5. Description of the Present Teachings

Thickness of Roughness

In some embodiments, surface roughness of appropriate size and distribution can increase or decrease turbulence at the boundary layer scale which feeds the shear layer along a bluff body and in turn affects the momentum of the separating shear layer.

Density of Roughness

In some embodiments, the density of roughness elements attached to the base has an impact on the amount of turbulence generated which subsequently determines whether VIFM will be suppressed.

Distribution of Roughness on the Surface

For VIM-Reduce+SRC to reduce/suppress VIV, roughness should be arranged with alternating strips of smooth and rough regions as shown in FIG. 5. A configuration of alternating smooth and rough patches is shown in FIG. 6. The roughness can be arranged in a wavy manner along the structure. The roughness can be distributed in a predetermined manner as spots on the structural surface or as a helical three-dimensional pattern around and along the structure. However, it should be appreciate that other distributions may be used depending upon the exact design criteria and environment.

Base of Roughness Elements

In some embodiments, the thickness of the base is a critical element in VIFM control. For suppression, roughness strips can be staggered or discontinuous (see FIG. 5 and FIG. 6) thus reducing the spanwise correlation length. Another example for suppressing VIV would be a wavy base resulting in reduced correlation.

3.1. Working Models

Six different models of the invention have been built and tested in the Low Turbulence Free Surface Water Channel of the Marine Hydrodynamics Laboratory of the University of Michigan, Ann Arbor. In our model tests, six different cylinders with diameters 1", 2.5", 3", 3.5", 5", 6" were used as a generic form of bluff body to demonstrate the concept. Decrease of amplitude and synchronization range was achieved in the laboratory as shown in FIG. 7.

Experimental Results

The following observations can be made on the amplitude of VIV, the range of synchronization, and the frequency of oscillation. Please refer to Table 1 herebelow:

| Case | Sand-paper | Grit size k ($10^{-6}$ m) | Sandpaper thickness k + P ($10^{-6}$ m) | Diameter D (inch) | k/D | k + P/D | No. of strips | Circumferential angle |
|---|---|---|---|---|---|---|---|---|
| 1 | P120 | 125 | 508 | 3.0 | 0.0016 | 0.0067 | 2 | ±64°-±80° |
| 2 | P36 | 538 | 1651 | 5.0 | 0.0042 | 0.0130 | 2 | ±80°-±105° |
| 3 | P80 | 201 | 711 | 5.0 | 0.0016 | 0.0056 | 2 | ±80°-±105° |
| 4 | P80 | 201 | 711 | 5.0 | 0.0016 | 0.0056 | 4 | ±80°-±105° ±117°-±140° |

3.1. Amplitude of Oscillation and Synchronization Range:

Results are presented based on two extreme locations of the sandpaper strips. In the first configuration, the sandpaper strips cover the entire range of oscillation of the separation point. In the second configuration, the sandpaper strips are placed right after the end of the separation zone. In the present experiments the maximum amplitude of oscillation for smooth cylinder seems unusually high, that is an amplitude ratio (A/D)>1.6. This high amplitude of oscillation is attributed to the high Reynolds number regime (TrSL3) at which the experiments were conducted. The downstream edge of the roughness strip at 80° (see FIG. 7) shows the results for Case 1 (3.0" cylinder). The amplitude of oscillation and range of synchronization reduce dramatically. At reduced velocity greater than 6.75, VIV is nearly suppressed reducing from A/D of 1.6 to 0.2. This can be attributed to the critical Reynolds number that must be reached before the roughness strips start increasing the amplitude and preserve VIV. Recall that the correlation length has been maintained to be equal to the entire cylinder length.

The upstream edge of the roughness strip at 80°: In this case, the roughness strips do not interact with the zone of flow separation. Instead, they interact with the shear layer separated from the cylinder. The results are shown in FIGS. 8 and 9. The amplitude of oscillation reduces but the synchronization range extends more than in the smooth cylinder VIV. The third and fourth strips, for Case 4, are placed further downstream of the cylinder between angles of 117°-140°. In Case 4, roughness covered nearly 25% of the cylinder surface. In comparison to the two-strip cases the four-strip cases affects the amplitude in the reduced velocity range of 4 to 6. Elsewhere it has minimal effect. The response character didn't change as the area of coverage of roughness increased from 12.5% (two strips) to 25% (four strips) confirming that strategically located roughness can be very effective in achieving the desired result.

3.2. Frequency of Oscillation:

The ratio of frequency of oscillation with respect to the natural frequency of the system in water ($f^*=f_{osc}/f_{n,water}$) is shown in FIG. 8. In the three cases shown in this figure, roughness strips were placed after the zone of separation point if the flow is assumed to be in the laminar regime. On the other hand if the flow has been energized to the point being effectively in the TrBL regime then the roughness strips is located right before the turbulent separation.

The upstream edge of the roughness strip at 80°: In this case, the thickness of the roughness strips and the size of the grit elements affect the added turbulence which in turn interacts with the shear layer. Further, the frequency of oscillation follows parallel to the Strouhal line $$\left(\frac{0.2 * U}{f_{n,water} D}\right)$$

as shown in FIG. 8. That is, the frequency of oscillation in the synchronization range is locked on to the frequency of shedding rather than the natural frequency in water. In Case 3 (5" cylinder with two P80 strips), vortex shedding behaves as in the case of a steady flow past a stationary cylinder with the Strouhal number of 0.185 instead of 0.2.

$$f_{osc} = f_{vz} = \frac{0.185 * U}{D}.$$

This phenomenon continues up to $f_{osc}/f_{n,water}=2$. At that point it appears that lock-on to 2 times $f_{osc}/f_{n,water}$ occurs.

4. Main Findings

Surface roughness has been used to reduce/suppress VIV of a circular cylinder in the TrSL3 regime. The basic principles for this methodology have been explained. The number of parameters involved in designing the roughness distribution is high and the tests presented in this paper are limited to studying the location of roughness in the form of sandpaper strips only. The sandpaper strips spanned the entire cylinder length in our tests. Breaking the strips into short ones would break the correlation length and obscure the effect of location of sand-strips with respect to the flow separation zone.

The results of the cylinder with roughness strips, undergoing vortex induced vibration in the TrSL3 regime are summarized as follows:

1. Reduction of VIV can be achieved by arranging roughness strips in multiple configurations where the spanwise correlation of flow separation is disrupted resulting in reduction of the correlation length.

2. Short roughness strips break the spanwise flow correlation and assist in reducing/suppressing VIV.

3. Roughness, when distributed properly, can reduce/suppress VIV.

4. Roughness can decrease the range of synchronization.

Figure 3:
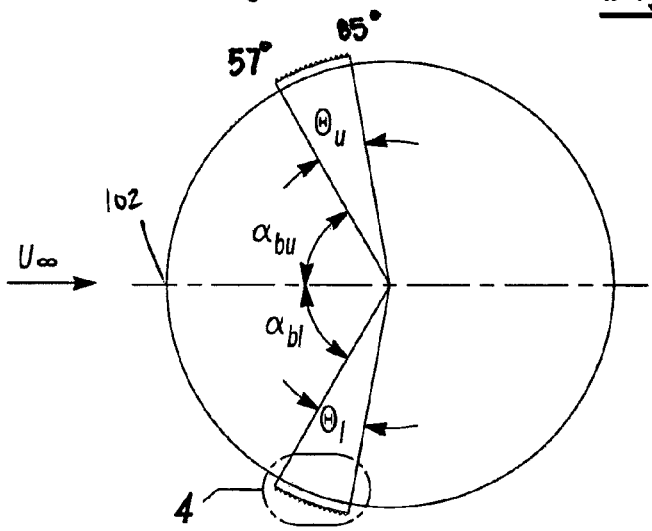
FIG. 3 is a schematic drawing illustrating a surface roughness member, in the form of sandpaper, formed on a body.

5. When the roughness strips were attached to the cylinder aft of the flow separation zone or stagnation point 102 (FIG. 3) (aft of an angle of 80°), the amplitude ratio (A/D) of the VIV response decreased but the range of synchronization was increased.

6. When the roughness strips were attached to the cylinder aft of the flow separation zone, the frequency character of VIV for a cylinder with roughness strips was similar to the case with roughness strips placed between 57°-80° in the beginning of the synchronization. For higher reduced velocity f* follows the Strouhal line (FIG. 8).

3.2. Alternative Implementations

Figure 1:
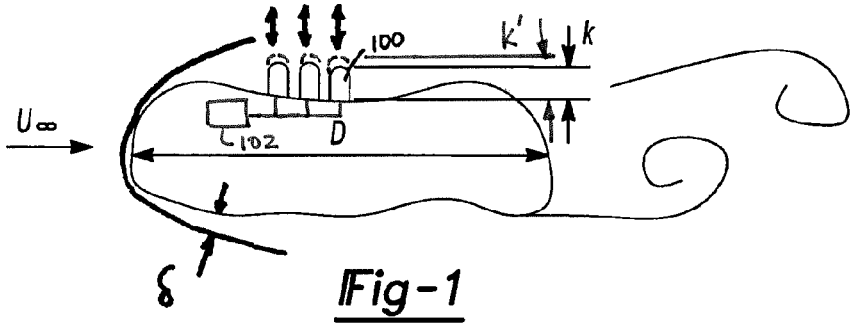
FIG. 1 is a schematic drawing illustrating roughness in terms of a protuberance on a body.

Several variations of the present teachings of VIM-Reduce+SRC or components thereof maybe equally effective in achieving VIFM control using surface roughness control. Specifically:

Control of VIFM through roughness maybe passive or active. Passive control was described above. Active control can be achieved by raising or by lowering surface roughness or components 100 (FIG. 1) thereof in response to flow variations. This can be achieved through mechanically actuated excrescences, electrically actuated excrescences, and the like (generally indicated at 102 in FIG. 1). In other words, the roughness zone of the present teachings can be an actively controllable roughness zone operable between a first roughness state and a second roughness state (e.g. a change between k and k' in FIG. 1), said first roughness state being different than said second roughness state. Such differences could include roughness size, roughness density, roughness configuration, or any other parameter effect fluid flow thereby.

The type of material used to fabricate surface roughness can be any material which satisfies the following requirements: Be rigid or flexible; have rough or smooth individual roughness elements; roughness elements can be metallic, composite, plastic or any other natural or manmade product.

The configuration of the surface roughness can have any form that can be modeled using its size, amount, distribution, and density as described in this disclosure. Only a few possible configurations are shown in FIG. 3 through FIG. 6 where $\alpha_{bu}$ is the angle of the beginning of the location of the roughness strip at the upper part of the body, $\alpha_{bl}$ is the angle of the beginning of the location of the roughness strip at the lower part of the body, $\Theta_u$ is the angle of the roughness strip at the upper part of the body, and $\Theta_l$ is the angle of the roughness strip at the lower part of the body. But it should be understood that variations exist within the scope of the present teachings.

Unique Benefits

The disclosed teachings of VIM-Reduce+SRC can be used to reduce/suppress VIFM when they become destructive. Circular cylindrical structures and other bluff bodies in fluid flow appear in many engineering disciplines such as offshore, civil, aerospace, mechanical, nuclear engineering. For example in offshore engineering, several thousand marine risers and pipelines are operating in VIV. Similarly, SPAR platforms, legs of tension leg platforms, mooring lines, marine cables, cooling towers, car antennas, and nuclear fuel control rods also operate in VIV. VIM-Reduce+SRC has the clear potential of reducing/suppressing VIV at minimal cost without significant increase in drag. The potential impact on numerous applications in many engineering disciplines is huge.

What is claimed is:

1. A system for reducing vortex induced forces on a bluff body disposed in a fluid, the fluid moving relative to the bluff body, said system comprising:

said bluff body having a surface, said bluff body being shaped to define a linear body dimension being the largest linear dimension of a cross section of said bluff body in the plane of the flow of the fluid, said bluff body being moveable in at least a direction generally perpendicular to the flow of the fluid; and a plurality of roughness zones disposed on said surface, each of said plurality of roughness zones defining a roughness height extending above said surface that is less than or equal to 5% of said linear body dimension, said plurality of roughness zones modifying the flow of the fluid to suppress fluid induced motion of said bluff body in the direction generally perpendicular to the flow of the fluid, wherein each of said plurality of roughness zones comprises a base and a grit, said grit being disposed on said base.

2. The system according to claim 1 wherein each of said plurality of roughness zones is disposed on said surface at a position upstream from a fluid flow separation point.

3. The system according to claim 1 wherein each of said plurality of roughness zones comprises a member coupled to said bluff body.

4. The system according to claim 3 wherein said member comprises sandpaper.

5. The system according to claim 1 wherein each of said plurality of roughness zones is integrally formed on said surface of said bluff body.

6. The system according to claim 1 wherein said bluff body is a cylinder defining a stagnation point and at least one of said plurality of roughness zones is disposed between about 80° and 103° behind said stagnation point when measured along an axis of said cylinder.

7. A system for suppressing vortex induced forces on a cylindrical bluff body disposed in a fluid, the fluid moving relative to the bluff body, said system comprising:

said cylindrical bluff body having a surface, said cylindrical bluff body defining a bluff body diameter, said cylindrical bluff body being moveable in a direction generally perpendicular to the flow of the fluid; and a plurality of roughness zones disposed on said surface, each of said plurality of roughness zones defining a roughness height extending above said surface that is less than or equal to 5% of said bluff body diameter, said plurality of roughness zones modifying the flow of the fluid to suppress fluid induced motion of said cylindrical bluff body within the fluid, wherein each of said plurality of roughness zones comprises a base and a grit, said grit being disposed on said base.

8. The system according to claim 7 wherein each of said plurality of roughness zones is disposed on said surface at a position upstream from a fluid flow separation point.

9. The system according to claim 7 wherein each of said plurality of roughness zones comprises a member coupled to said bluff body.

10. The system according to claim 9 wherein said member comprises sandpaper.

11. The system according to claim 7 wherein each of said plurality of roughness zones is integrally formed on said surface of said bluff body.

12. The system according to claim 7 wherein said cylindrical bluff body defines a stagnation point and at least one of said plurality of roughness zones is disposed between about 80° and 103° behind said stagnation point when measured along an axis of said cylinder.

* * * * *